United States Patent [19]

Weinert

[11] 4,349,384

[45] Sep. 14, 1982

[54] METHOD FOR THE MANUFACTURE OF SEGMENTS FOR COMMUTATORS

[75] Inventor: Hans Weinert, W.-Niederbachem, Fed. Rep. of Germany

[73] Assignee: Ringsdorff-Werke GmbH, Bonn, Fed. Rep. of Germany

[21] Appl. No.: 163,731

[22] Filed: Jun. 27, 1980

[30] Foreign Application Priority Data

Jul. 23, 1979 [DE] Fed. Rep. of Germany ..... 2929731

[51] Int. Cl.[3] ..... B22F 7/02

[52] U.S. Cl. ..... 75/208 R; 29/597; 75/224; 75/226; 310/233; 310/234; 428/548; 428/552

[58] Field of Search ..... 75/208 R, 226, 224; 428/548; 310/233; 29/597

[56] References Cited

U.S. PATENT DOCUMENTS

| | | | |
|---|---|---|---|
| 2,053,662 | 9/1936 | Hardy | 29/597 |
| 3,248,215 | 4/1966 | Bonis et al. | 75/226 |
| 3,539,854 | 11/1970 | Futterer | 310/233 X |
| 3,837,819 | 9/1974 | Hibbs | 310/233 X |

FOREIGN PATENT DOCUMENTS

| | | | |
|---|---|---|---|
| 63662 | 7/1892 | Fed. Rep. of Germany . | |
| 54-132413 | 10/1979 | Japan . | |
| 574799 | 10/1977 | U.S.S.R. | 310/252 |

OTHER PUBLICATIONS

Chem. Abstracts 92 (May 5, 1980), p. 309, Item 151 694 e "Wear Resistant Sintered Alloy Composites for Sliding Use".

*Primary Examiner*—Helen M. McCarthy

*Attorney, Agent, or Firm*—Herbert L. Lerner; Laurence A. Greenberg

[57] ABSTRACT

A segment of a commutator made by (a) placing a first layer of copper powder and on top thereof a second layer of a mixture of carbon powder and a binder into a die with a cavity shaped like the segment, (b) densifying the powder layers to produce a blank having the form of the segment, and (c) sintering the blank at an elevated temperature to cause the powder particles to cohere and the layers to firmly join together.

10 Claims, 4 Drawing Figures

METHOD FOR THE MANUFACTURE OF SEGMENTS FOR COMMUTATORS

BACKGROUND OF THE INVENTION

1. Field of the Invention

The invention relates to segments for commutators and more particularly refers to new and improved segments which have a base part of copper or copper alloy and a running layer of carbon which is bonded materialwise to the base part, methods for manufacture of the segments, and the use of such segments.

2. Description of the Prior Art

It is known to improve the commutation of d-c and universal motors through the use of commutators which consist entirely of carbon, or the surface of which is provided with a layer of carbon. The advantage, which is considerable over commutators of metal, is accompanied by some important disadvantages which have so far prevented a larger use of these commutators, particularly, 1. the technically difficult and expensive connection of the winding ends of the commutator winding to the carbon of the segment,
2. the relatively low strength with respect to carbon and its bond with the base, and
3. the high electric resistivity of the carbon relative to copper.

In composite segments, the higher electric resistivity of the carbon has a smaller effect, with a thinner carbon running layer connected to the metal base. Composite forms also are not subject to the limitations given by the lower strength of the carbon, and there has therefore been no lack of attempts to solve the indicated problems in this manner. For instance, it is known from German Pat. No. 63,622 to apply a thin carbon coating to segments of copper. However, it has not been possible so far to realize on a technical scale the advantages of composite segments which have a metallic base or base part and a running layer consisting essentially of carbon because the strength of the bond between the base part and the running layer was not sufficient. Also the high voltage drop was not satisfactory.

SUMMARY OF THE INVENTION

It is, therefore, an object of the invention to provide a composite segment and a method for manufacturing it which does not have the disadvantages mentioned and in particular makes possible the manufacture of a strong bond with small voltage drop between the parts of the segments.

With the foregoing and other objects in view, there is provided in accordance with the invention a method for the manufacture of segments having a base part of copper and an upper layer of carbon joined to the base part, for a commutator, which comprises:

(a) placing a first layer of copper powder and on top thereof a second layer of a mixture of carbon powder and a binder into a die with a cavity shaped like the segment, (b) densifying the powder layers to produce a blank having the form of the segment, and (c) sintering the blank at an elevated temperature to cause the powder particles to cohere and the layers to firmly join together.

Other features which are considered as characteristic for the invention are set forth in the appended claims.

Although the invention is illustrated and described herein as embodied in a method for the manufacture of segments for commutators, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
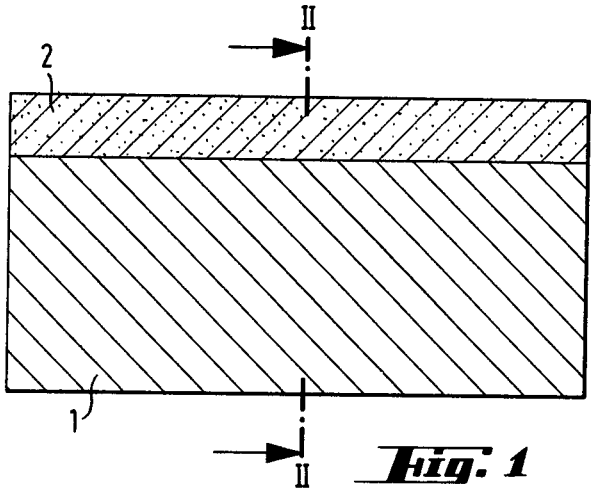
FIG. 1 shows the longitudinal cross section of a segment with a base part of copper or copper alloy and an upper layer of carbon, according to the invention.
Figure 2:
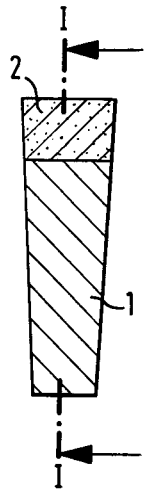
FIG. 2 is a cross section taken along line II—II in FIG. 1, and shows a trapezoidal cross section.

In accordance with the invention a first layer of copper powder and on top thereof a second layer of a mixture containing a carbon powder and a binder are filled into a mold. A blank exhibiting the shape of the segment is produced through densification of the powder layers. The blank is sintered at an elevated temperature and its base part is provided with recesses for receiving insulating materials.

The term copper powder is understood in the following and claims also to include powders with alloy additives, for instance tin or lead. The term carbon includes all forms of the element carbon, which have a layer structure at least in the atomic region, such as carbon black, petroleum coke, electrographite and natural graphite. These types of carbon are first comminuted, classified and mixed with a binder which joins the individual carbon granules together in an electrically conducting manner. Suitable above all are binders which set at room temperature or at a somewhat elevated temperature and can be pyrolized at a higher temperature, for example, phenolformaldehyde resins. It is advantageous to make the thickness of the powder layers so that the segment has the predetermined dimensions after densification and sintering. The same applies to the mold. For the densification of the powder layers, pressures of 0.3 to 3 bar are generally sufficient. The sintering temperature of the blanks advantageously is 300° to 800° C.

According to another preferred embodiment, the powder layers are densified at an elevated temperature, preferably between about 100° and 200° C. and the binder, for instance, a novolak resin is allowed to set in the process. The segment is then heated to a temperature approximately in the range between 300° and 800° C. In the process, the copper powder is sintered and the binder is pyrolized, forming a residue consisting essentially of carbon. The segment base of copper and the carbon running layer are firmly joined together in this treatment. An additional increase of the strength of the bond is achieved by arranging a further layer which consists of a copper-carbon powder mixture between the copper layer and the carbon layer. This embodiment is advantageous for commutators which are subject to particular mechanical and thermal stresses.

The individual segments, which preferably are of trapezoidal cross section and the running layer of which amounts to less than 30% of the height of the segment, are assembled together with mica leaves to form a commutator in known manner. It is advantageous to provide the base parts of the segments first with recesses, as for example, to receive conical side rings and other clamping organs, by milling, drilling or similar operations. Part of the running layer on the winding side is removed and the ends of the turns of the commutator winding are connected to the exposed copper surface by soldering or welding to improve the contact.

Segments for commutators made in accordance with the invention exhibit considerably higher strength than comparable segments of carbon especially since forces acting on the segments are taken up almost exclusively by the base part consisting of metal and bending and tension stresses are practically eliminated in the running layer of carbon. The risk of breakage if the segments are used in commutators is accordingly small. The ends of the turns can be fastened to the base part simply and securely after part of the running layer is, optionally, removed and, finally, the voltage drop between the carbon and the copper layer is particularly small.

Figure 3:
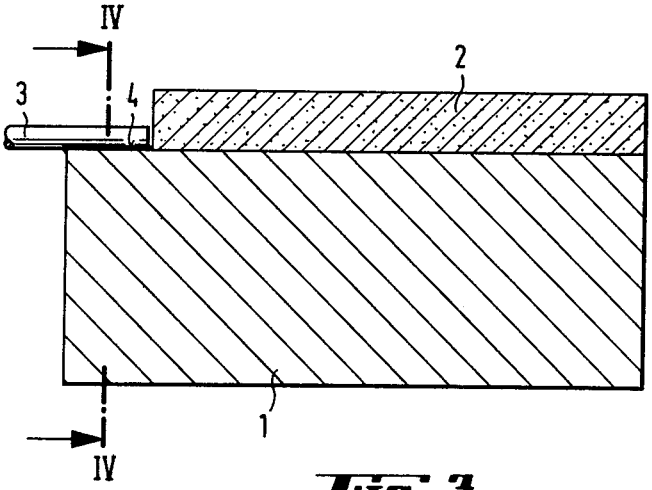
FIG. 3 is the longitudinal cross section taken along line III—III in FIG. 4 of a segment with winding ends of the commutator winding soldered on, and FIG. 4 is a cross section taken along line IV—IV in FIG. 3.
Figure 4:
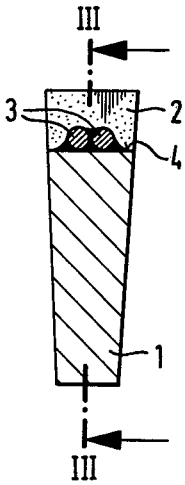

In the following, the invention will be explained in greater detail referring to an example and the drawings. In the drawings, 1 is the base part of the segment, which has a trapezoidal cross section. Numeral 2 designates the running layer of carbon, the thickness of which is only a fraction of the total height of the segment. In the presentation according to FIGS. 3 and 4, part of the exposed surface 4 of the base part 1 is fastened to the end of the turns 3 by soldering.

For fabricating the segment, a layer of copper powder with a grain size of $<0.063$ mm is filled into a die having the shape of the finished segment. The surface of the layer is wiped even and a second layer is applied on top which second layer consists of a mixture containing 85 parts natural graphite with a grain size less than 0.1 mm and 15 parts phenolformaldehyde resin. The layers were densified with a pressure of about 2 bar and the blank was sintered at a temperature of about 340° C. in a reducing atmosphere. The sintering time was 6 hours.

Separation of the segment into the layers after the sintering was impossible without completely destroying the segment. The measured bulk density of fragments from the layers was about 7.0 and 1.8 g/cm$^3$ for the base part and the running layer, respectively.

There is claimed:

1. Method for the manufacture of segments having a base part of copper and an upper layer of carbon joined to the base part, for a commutator, which comprises:

(a) placing a first layer of copper powder and on top thereof a second layer of a mixture consisting entirely of carbon powder and a pyrolyzable, carbonaceous binder into a die with a cavity shaped like the segment, (b) densifying the powder layers to produce a blank having the form of the segment, (c) sintering the blank at an elevated temperature to cause the powder particles to cohere and the layers to firmly join together, and (d) providing the base part with recesses for receiving insulating material.

2. Method according to claim 1, wherein another layer of a mixture of copper powder and carbon powder is arranged between said copper powder layer and said carbon powder layer.

3. Method according to claim 1, wherein the powder layers are densified by the simultaneous action thereon of superatmospheric pressure and elevated temperature.

4. Method according to claim 2, wherein the powder layers are densified by the simultaneous action thereon of superatmopsheric pressure and elevated temperature.

5. Method according to claim 1, wherein the thickness of said upper layer of carbon is less than 30% of the height of the segment.

6. Method according to claim 2, wherein the thickness of said upper layer of carbon is less than 30% of the height of the segment.

7. Method according to claim 5, wherein the segment has a trapezoidal cross section.

8. Method according to claim 6, wherein the segment has a trapezoidal cross section.

9. Segments having a base part of copper and an upper layer of carbon joined to the base part, for a commutator produced according to the method of claim 1.

10. Segments having a base part of copper and an upper layer of carbon joined to the base part, for a commutator produced according to the method of claim 2.

* * * * *